US007774961B2

(12) United States Patent
Bopp et al.

(10) Patent No.: US 7,774,961 B2
(45) Date of Patent: Aug. 17, 2010

(54) LUGGAGE IDENTIFICATION APPARATUS AND METHOD

(76) Inventors: David W. Bopp, PO Box 4748, Clifton Park, NY (US) 12065; Randall W. North, 5957 State Route 40, Argyle, NY (US) 12809

( * ) Notice: Subject to any disclaimer, the term of this patent is extended or adjusted under 35 U.S.C. 154(b) by 124 days.

(21) Appl. No.: 12/138,784

(22) Filed: Jun. 13, 2008

(65) Prior Publication Data

US 2009/0307945 A1 Dec. 17, 2009

(51) Int. Cl.
*G09F 3/20* (2006.01)

(52) U.S. Cl. ..... 40/6; 40/1.5; 40/661.11

(58) Field of Classification Search ..... 40/1.5, 40/6, 329, 661.11, 661.04, 668; 24/114.05; 2/246, 265

See application file for complete search history.

(56) References Cited

U.S. PATENT DOCUMENTS

| | | | | |
|---|---|---|---|---|
| 163,566 | A | | 5/1875 | Barker |
| 226,825 | A | | 4/1880 | Beatty |
| 512,468 | A | | 1/1894 | Grundy |
| 626,191 | A | | 5/1899 | Reenstierna |
| 1,586,161 | A | | 5/1926 | Nails |
| 1,618,073 | A | | 2/1927 | Flint |
| 1,980,744 | A | | 11/1934 | Borchert et al. |
| 2,079,742 | A | | 5/1937 | Kocher |
| 2,088,689 | A | | 8/1937 | Chernow |
| 2,902,782 | A | | 9/1959 | Coleman |
| 3,455,042 | A | * | 7/1969 | Carr et al. ..... 40/1.5 |
| 3,546,797 | A | * | 12/1970 | Oleson ..... 40/1.5 |
| 3,640,008 | A | * | 2/1972 | Crail ..... 40/638 |
| 3,999,639 | A | | 12/1976 | Walters |
| 4,555,435 | A | | 11/1985 | Walter |
| 4,776,043 | A | | 10/1988 | Coleman |
| 4,961,275 | A | * | 10/1990 | Klein ..... 40/1.5 |
| 4,984,684 | A | * | 1/1991 | Conner et al. ..... 206/315.3 |
| 5,103,579 | A | * | 4/1992 | Mayers ..... 40/1.5 |
| 5,282,297 | A | | 2/1994 | Angus |
| 5,714,234 | A | | 2/1998 | Robertson |

* cited by examiner

*Primary Examiner*—Gary C Hoge
(74) *Attorney, Agent, or Firm*—Schmeiser, Olsen & Watts, LLP

(57) ABSTRACT

A removable luggage identification apparatus includes a substantially planar body, a plurality of fastener seats, each fastener seat being located near the perimeter of the body, and a plurality of mechanical fastener members, each fastener member being located and configured so that a retaining head of each fastener member is significantly laterally shielded by physical structures of the indicia body, thereby preventing the fastener members from being snagged by lateral contact with external objects. A corresponding method of identifying luggage is provided.

18 Claims, 5 Drawing Sheets

FIG. 2

LUGGAGE IDENTIFICATION APPARATUS AND METHOD

BACKGROUND OF THE INVENTION

1. Technical Field

The present invention generally relates to luggage identification. More particularly, the present invention relates to a removable identification device formed to securely attach to luggage in a manner that avoids unwanted removal of the device.

2. Related Art

It is important for travelers to be able to readily identify their luggage so that they can maintain proper possession of their bagged goods. There are various containers that may be utilized to hold belongings. Typical luggage containers, such as suitcases, duffle bags, tote bags, valises, carpet bags, or garment bags, etc, come in a variety of shapes, sizes, materials and colors. However, as many travelers are acutely aware, while there may be many different types of luggage containers, it is still frequently the case that different luggage containers have similar physical appearance. For instance, two different garment bags may be the same color and may be formed of similar material, two different suitcases may shaped with very similar exterior features, such as wheels and handles, and may be similarly sized, or two duffle bags may have similar configurations, etc. Similarity in appearance can lead to confusion among travelers over the proper ownership of luggage containers. Hence, travelers have sought ways to peculiarly identify luggage so that they or others will avoid mistaking their baggage structures for other similar looking luggage containers.

Various known means and mechanisms have been utilized by travelers to help identify luggage containers. One basic identification means travelers have used to identify luggage is to attach a unique physical object to a luggage container so that the container can be more readily identifiable by viewing the unique physical object. For instance, colored ribbons, tapes, or strings, etc. have been attached to luggage containers to help set apart the unique appearance of the luggage containers. However, there are only so many colors of string or tape, and it is not uncommon to see two similar looking luggage containers having two similar looking physical objects attached in similar manners, even though the luggage is owned by different travelers. Often physical objects that are attached to identify luggage containers are not appealing to the eye. Furthermore, many standard luggage identification objects, such as a basic ribbon tied to the handle of a suitcase, do not provide specific identification information about the owner of the luggage. Moreover, paper tags, stickers or glue-on labels are often not durable for repeated use or unable to withstand wet conditions.

Another common disadvantage of typical luggage identification means is that the standard identification objects commonly attached onto luggage containers can get snagged during normal travel handling processes causing the identification objects to become unattached from the luggage containers rendering identification inoperable. For instance, flexible ID patches that may be attached to luggage containers through VELCRO® fasteners can be readily snagged, rubbed, torn or otherwise ripped off of the luggage containers. In addition, pinned-on rigid ID buttons can get caught and popped-off or snapped-off of luggage containers during typical baggage handling processes. Still further, pins or other components of known ID tags may need to be significantly bent in order to secure the ID tags to luggage, rendering the bent pins subject to failure because or fatigue. Accordingly, a need exists for providing an improved luggage identification apparatus and method.

SUMMARY OF THE INVENTION

The present invention provides a removable luggage identification apparatus and method for securely attaching the identification apparatus to a luggage container in a manner that avoids unwanted removal of the apparatus.

A first aspect of the invention provides a removable luggage container identification apparatus comprising: a flexible substantially planar body, having a first face and an opposing second face, the first face including an identification indicia located thereon; a plurality of fastener seats, each fastener seat being located near the perimeter of the first face of the planar body; and a plurality of mechanical fastener members, each fastener member including: a retaining head, sized and shaped to correspond in dimension with a fastener seat; a rigid pin portion, configured to pierce and transverse both the substantially planar body and an external wall of a luggage container; and a pin retaining component, configured to securely releasably engage the pin portion; wherein, each mechanical fastener member is seated in a corresponding fastener seat so that edges of the retaining head of each seated mechanical fastener member are significantly obscured by the fastener seat; and further wherein an immediate portion of the second face of the substantially planar body tightly abuts the immediate outside surface of the external wall of the luggage container when the pin portion of any seated fastener member is securely engaged by the corresponding pin retaining component as the pin retaining component rests tightly against the immediate inside surface of the external wall of the luggage container.

A second aspect of the invention provides a removable luggage container identification apparatus comprising: an indicia body, the indicia body having identification indicia located thereon; and a plurality of mechanical fastener members, each fastener member including a rigid pin portion extending from a retaining head and a separable pin retaining component operable to securely releasably engage an external surface feature of the pin portion to facilitate attachment of the indicia body to a luggage container by binding an external surface of the luggage container and at least a portion of the indicia body between the retaining head and the pin retaining component when the pin portion is positioned to extend through the external surface of the luggage and through the at least a portion of the indicia body; wherein when the indicia body is attached to the luggage container, each fastener member is located and configured so that the retaining head of each fastener member is substantially laterally shielded by physical structures of the indicia body, thereby preventing each of the fastener members from being snagged by lateral contact with external objects.

A third aspect of the invention provides a method of identifying a luggage container, the method comprising: providing a luggage container identification apparatus including: a flexible indicia body having an identification indicia located thereon; a plurality of fastener seats, each fastener seat being located near the perimeter of the flexible indicia body; and a plurality of mechanical fastener members, each fastener member including: a retaining head, sized and shaped to correspond in dimension with a fastener seat; a rigid pin portion, configured to pierce and extend through both an external wall of a luggage container and at least a portion of the flexible indicia body; and a pin retaining component, configured to securely releasably engage an external surface feature of the pin portion; positioning each mechanical fastener member in a corresponding fastener seat so that edges of the retaining head of each seated mechanical fastener member are significantly obscured by the fastener seat; and attaching the indicia body to the luggage container by binding the external wall of the luggage container and the at least a portion of the indicia body between the retaining head and the pin retaining component when the pin portion is positioned to extend through the external wall of the luggage container and through the at least a portion of the indicia body; wherein when the indicia body is attached to the luggage container, each fastener member is located and configured so that edge portions of each retaining head of each fastener member are significantly laterally shielded by physical structures of the indicia body, thereby preventing the fastener members from being snagged by lateral contact with external objects.

BRIEF DESCRIPTION OF THE DRAWINGS

Some of the embodiments of this invention will be described in detail, with reference to the following figures, wherein like designations denote like members, wherein.

DETAILED DESCRIPTION OF THE INVENTION

Figure 1:
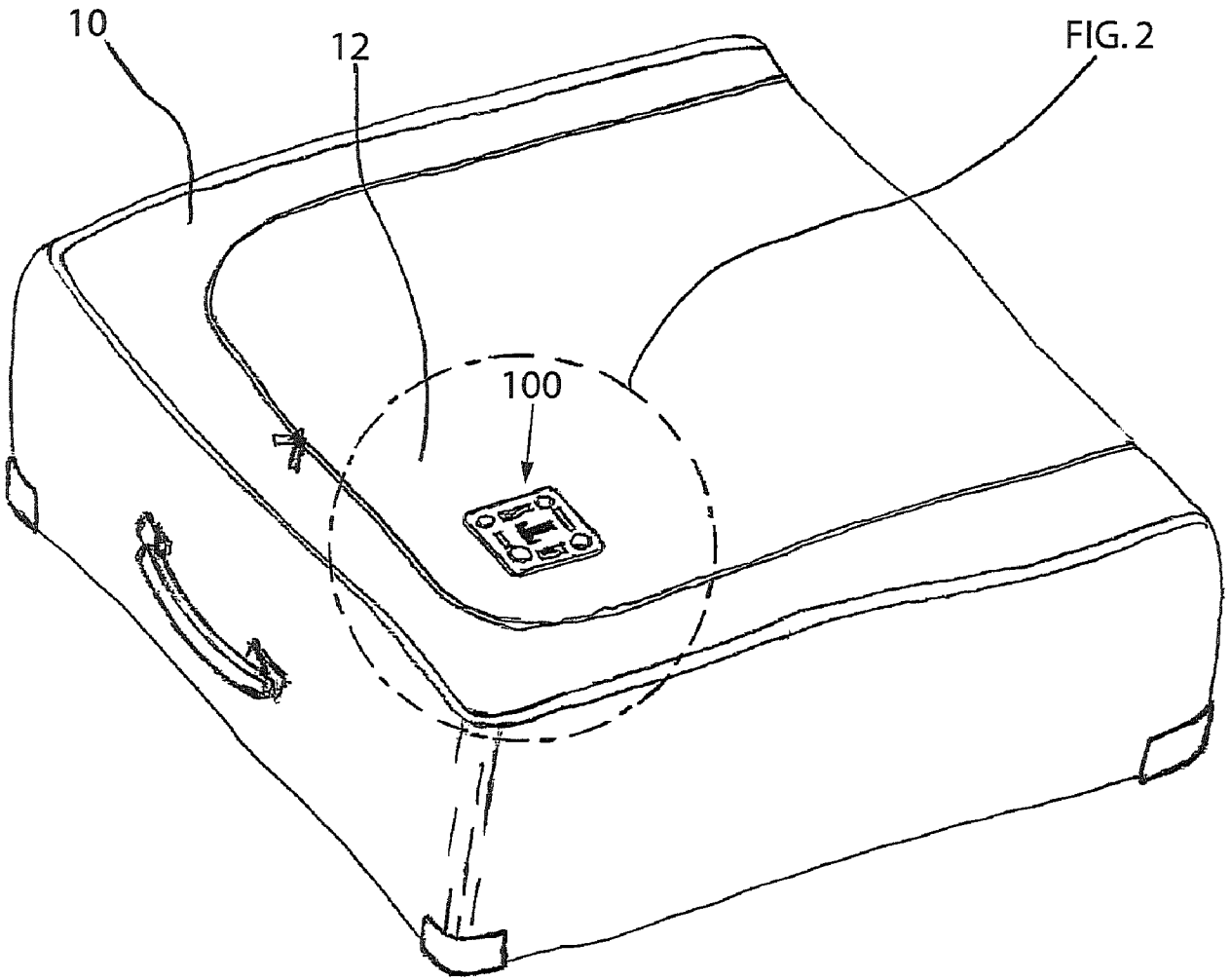
FIG. 1 depicts a side perspective view of an embodiment of a luggage identification apparatus, in accordance with the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply for exemplary purposes in depicting a possible embodiment or embodiments of the present invention. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

With reference to the drawings, FIG. 1 depicts a side perspective view of an embodiment of a luggage identification apparatus 100. Embodiments of a luggage identification apparatus 100 may be attached to various luggage containers, such as the depicted luggage container (suitcase) 10. More particularly, embodiments of a luggage identification apparatus 100 may be attached to an external surface or wall 12 of a luggage container 10. Those in the art should appreciate that embodiments of a luggage identification apparatus 100 may be attached to variously sized, shaped or colored luggage containers 10. Preferably, a luggage container 10, to which embodiments of a luggage identification apparatus 100 may be attached, will have external walls that may be pierced or punctured without undue effort. Hence, while embodiments of a luggage identification apparatus 100 described herein may be operably attached to a luggage container 10 having thin external walls 12 made of soft metals, such as aluminum, or solid plastic materials, such as high density polyethylene, it may be easier to attached luggage identification apparatus embodiments 100 to luggage containers 10 having external walls 12 made of textiles, such as canvas, nylon fabrics, or other woven materials. Removable attachment of embodiments of a luggage apparatus 100 to embodiments of a luggage container 10 wall 12 may be effectuated on external container walls 12 congruent with an opening of the luggage container 10, such as a zippered side of the suitcase. Nevertheless, it should be recognized that embodiments of a luggage apparatus 100 may be attached to any surface or wall 12 of a luggage container 10 that would facilitate visible observation of the luggage identification apparatus 100.

Figure 2:
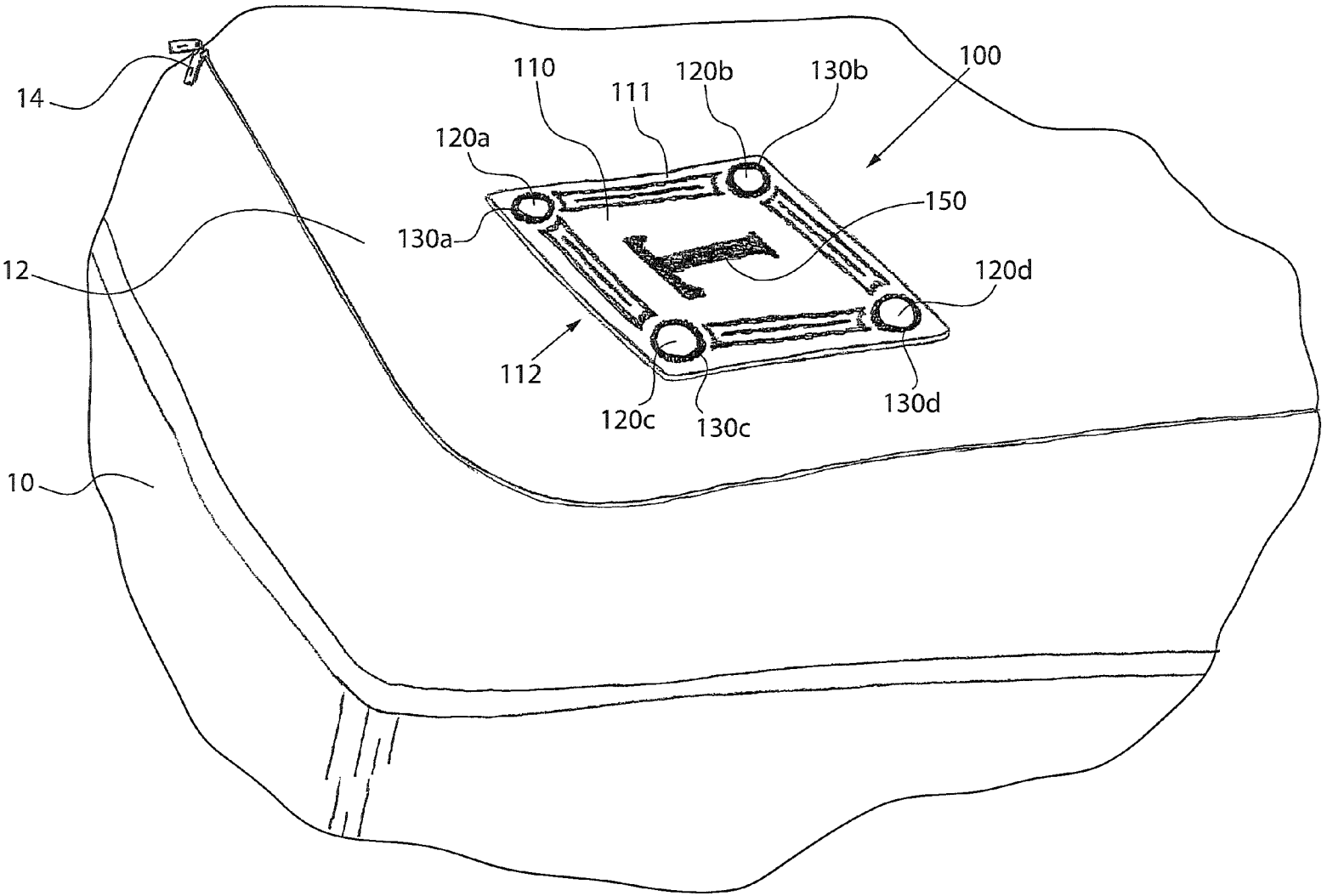
FIG. 2 depicts an exploded partial perspective view of the embodiment of the luggage identification apparatus depicted in FIG. 1, in accordance with the present invention.

Referring still to the drawings, FIG. 2 depicts an exploded partial perspective view of the embodiment of the luggage identification apparatus 100 depicted in FIG. 1. Embodiments of a luggage identification apparatus 100 may comprise a substantially planar indicia body 110. The body may be flexible allowing it to bend and twist with the possible bending and twisting of the wall(s) of the luggage container 10 onto which it may be attached. While embodiments comprising a rigid indicia body 110 may be employed, care should be taken (with regard to structure and placement) to minimize the potential for any part of the body 110 to get caught or snagged on something during typical baggage handling procedures. The substantially planar indicia body 110 may include a first face 111 and an opposing second face 112 (not shown, but having a direction arrow indicating location opposite the first face 111). The first face 111 may include identification indicia 150 located thereon. The indicia 150 may comprise embroidered text, such as monogrammed initials, words, phrases or logos; it may include silk-screened printed identification means; lights, such as battery operated fiber-optics or LED's, or otherwise observable elements. Indicia 150 may be categorized according to a variety of topics. For example, indicia may depict logos of favorite sports teams, smiley faces, pictures of family members, national flags, or patriotic emblems, etc. Certain embodiments may include swappable indicia, such as VELCRO® patches that can be removably placed on the first face 111 of the substantially planar indicia body 110. However, in the case of VELCRO® patches, the indicia body 110 itself may be constructed to serve as identification means lest the patch indicia 150 is accidentally dislodged from the first face 111 of the indicia body 110 of the luggage identification apparatus 100. Indicia 150 may be variably sized and or shaped, but care should be taken configure the indicia 150 so as to reduce risk of possible catching or snagging. Moreover, the indicia should not interfere with secure attachment of the luggage identification apparatus 100 to a luggage parcel 10.

In addition, embodiments of a luggage identification apparatus 100 may include a plurality of fastener seats 130, each fastener seat, such as fastener seats 130*a*-130*d*, being located near the perimeter of the first face 111 of the substantially planar indicia body 110. By being located near the perimeter of the substantially planar indicia body, the fastener seats 130 may facilitate more secure attachment of embodiments of the luggage identification apparatus 100 to a luggage container 10 because the edges of the substantially planar indicia body 110 may be more firmly secured against the external wall(s) of the luggage container 10.

Still further, embodiments of a luggage identification apparatus 100 may include a plurality of mechanical fastener members 120. Each fastener member, such as fastener members 120*a*-120*d*, may include three primary components (discussed in further detail in relation to FIGS. 4-5): a retaining head 122, a rigid pin portion 124, and a pin retaining component 126.

Figure 3A:
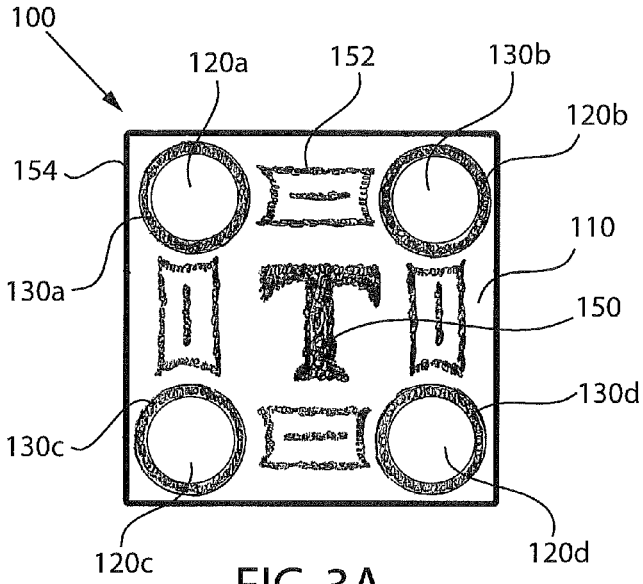
FIG. 3A depicts a top view of one embodiment of a luggage identification apparatus, in accordance with the present invention.
Figure 3B:
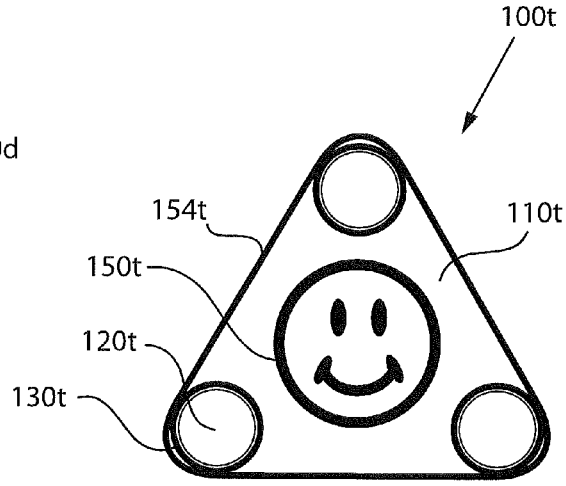
FIG. 3B depicts a top view of another embodiment of a luggage identification apparatus, in accordance with the present invention.
Figure 3C:
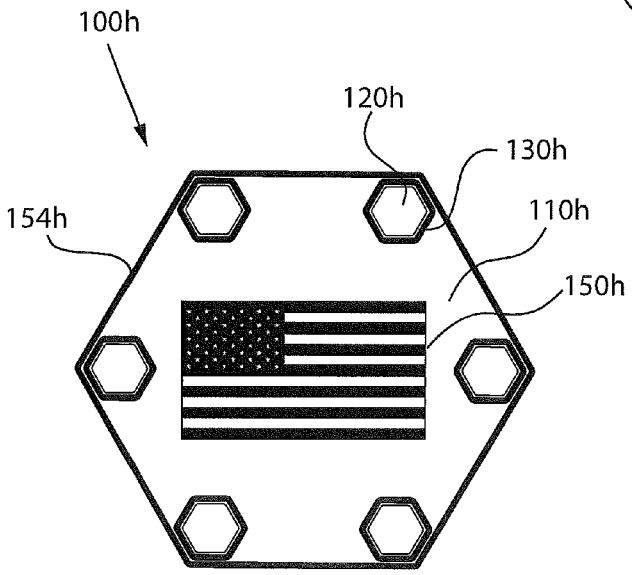
FIG. 3C depicts a top view of still another embodiment of a luggage identification apparatus, in accordance with the present invention.

With continued reference to the drawings, FIGS. 3A-3C depict top views of three, merely exemplary embodiments of a luggage identification apparatus 100. FIG. 3A shows an embroidered indicia body 110 wherein the indicia 150 constitutes the embroidered initial "T." The indicia body 110 may have a merrowed edge 154 comprising a circumferential layer of embroidered stitching. The merrowed edge 154 may help to substantially laterally shield the fastener members 120*a*-120*d* from being snagged by lateral contact with external objects during typical luggage handling processes. In addition, the first face 111 of the body may include further decorative embroidery such as the designs 152. Notably, the mechanical fastener members 120 are significantly nestled into embroidered fastener seats 130 that serve to protect the fastener members from snagging, catching, or other laterally initiated dislodgement forces. As illustrated in FIGS. 3B and 3C, embodiments of a luggage identification apparatus 100 may be variously sized and shaped, such as the triangle luggage ID apparatus 100*t* and the hexagonally shaped luggage ID apparatus 100*h*. For instance, the indicia body 100*t* of the substantially triangular luggage identification apparatus 100*t* may be molded from a soft polymeric material such as rubber or synthetic rubber allowing the ID apparatus 100*t* to be somewhat flexible. Notably, the three points of the triangle-shaped luggage ID apparatus 100*t* have been rounded to help diminish the possibility of snagging during normal luggage handling operations. The fastener seats 130*t* may be integrally molded with the indicia body 100*t* and shaped so that corresponding mechanical fastener members 120*t* may be seated therein to so that edges of each seated mechanical fastener member are significantly obscured by the corresponding fastener seats. The perimeter of the indicia body 100*t* may be merrow-like in that it is thicker than the rest of the indicia body, thereby helping to protect the fastener members 120*t* from snagging, catching, or other laterally initiated dislodgement forces. Furthermore, the smiley face indicia 150*t* may also be integrally molded and formed as part of the substantially planar indicia body 100*t*. The embodied luggage ID apparatus 100*h* may have a stitched hexagonal indicia body 100*h*, wherein embroidered fastener seats 130*h* may be positioned at each of the six corners of the hexagonal indicia body 110*h* near the perimeter 154*h* that may comprise an embroidered merrowed edge. Notably, visible head portions of the mechanical fastener members 120*h* may be formed in any shape, such as the hexagonal shape depicted. However, the mechanical fastener members 120*h* should preferably be shaped according to the shape of corresponding fastener seats 130*h*, so that each fastener member may located and configured so that it is significantly laterally shielded by physical structures of the indicia body, thereby preventing the fastener members from being snagged by lateral contact with external objects. The distinct hexagonal shape of the indicia body 100*h* of the luggage ID apparatus 100*h* may in and of itself serve as indicia. However a further indicia patch 150*h*, such as the depicted flag, may be attached to the indicia body 100*h* via VELCRO® hook and loop fasteners.

Figure 4A:
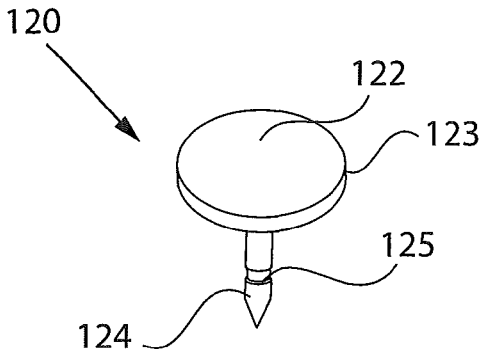
FIG. 4A depicts a top perspective view of part of an embodiment of a mechanical fastener member of an embodiment of a luggage identification apparatus, in accordance with the present invention.
Figure 4B:
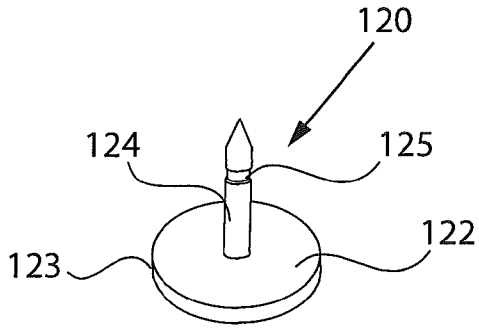
FIG. 4B depicts a bottom perspective view of part of the embodiment of the mechanical fastener member of FIG. 4A, in accordance with embodiments of the present invention.
Figure 5:
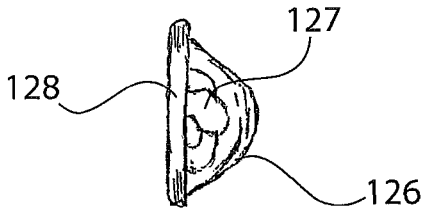
FIG. 5 depicts a side view of an embodiment of a retaining component of an embodiment of a mechanical fastener mechanical fastener of an embodiment of a luggage apparatus, in accordance with the present invention.

As shown in FIGS. 4-5, each fastener member 120 may include a rigid pin portion 124 extending from a retaining head 122 and a separable pin retaining component 126 operable to securely releasably engage an external surface feature 125, such as a groove, on the pin portion 124 to facilitate attachment of the indicia body 110 to a luggage container 10. A retaining head 120 may be sized and shaped having an edge(s) 123 corresponding in dimension with a fastener seat(s) 130, such as the embroidered fastener seats depicted in FIGS. 3A, 3C, 6, 7A and 7B or the molded fastener seats 130 depicted in FIG. 3B. The retaining head 122 should preferably be configured to avoid snagging being substantially smooth without significant protruding elements. Embodiments of a fastener member 120 may include a rigid pin portion 124 configured to pierce and transverse both the substantially planar indicia body 110 and an external wall 12 of a luggage container 10 (see FIG. 6). The pin portion 124 may have a length corresponding to the combined thickness of an indicia body and the thickness an external wall 12 of a luggage container 10. In addition, embodiments of a fastener member 120 may include a pin retaining component 126. The pin retaining component 126 may be configured to securely releasably engage the pin portion 124. For instance, the fastener member 120 may be a clutch pin, having a pin retaining member 126 that includes at least one compliant squeeze tab 127 that may releasably engage a corresponding external surface feature 125 formed on the pin portion 124. When the squeeze tab 127 is in a locked position, in engagement with the external surface feature 125 of the pin portion 124, the engagement between the two components can be made very secure due to the physical interference of the parts that be efficiently negated by squeezing the tab 127 to disengage the parts.

Figure 6:
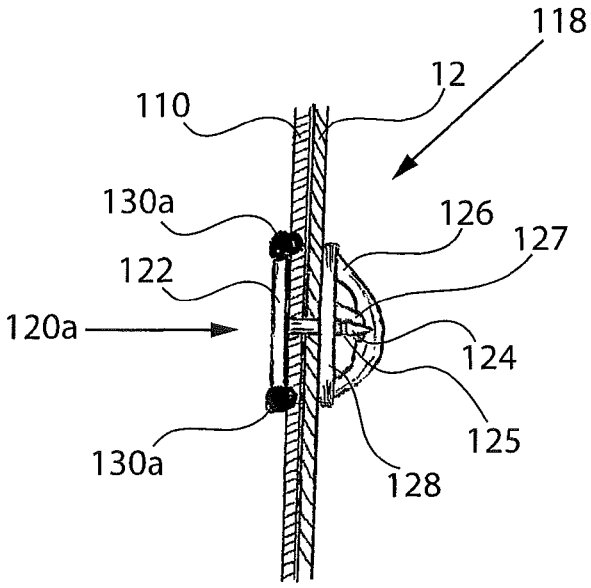
FIG. 6 depicts a side cross-section view of an embodiment of a luggage identification apparatus, in accordance with the present invention.

The pin retaining component 126 may securely releasably engage the external surface feature 125 of the pin portion 124 to facilitate attachment of the substantially planar indicia body 110 to a luggage container 10 by binding an external surface 12 of the luggage container 10 and at least a portion of the indicia body 110 between the retaining head 122 and an abutment surface 128 of the pin retaining component 126 when the pin portion 124 is positioned to extend through the external surface 12 of the luggage container 10 and through the at least a portion of the indicia body 110, as is depicted in FIG. 6. As further depicted in FIGS. 7A and 7B, when the indicia body 110 is attached to the luggage container 10, each fastener member 120 is located and configured so that the edge portions 123 of each retaining head 122 of each fastener member 120 are significantly laterally shielded by physical structures, such as the fastener seats 130, of the indicia body 110, thereby preventing the fastener members 120 from being snagged by lateral contact with external objects. Notably, the retaining head 122*h* of mechanical fastener 120*h* depicted in FIG. 7B may include a bulging or thickened portion. However, the bulging portion of the retaining head 122*h* is smooth so as to avoid causing possible snagging of catching problems during normal luggage handling process. When any mechanical fastener member 120 is seated in a corresponding fastener seat 130, there is a portion of each edge 123 of each retaining head 122 of the seated fastener member 120 that is significantly obscured by the fastener seat 130. Accordingly, an immediate portion 118 of the second face 112 of the substantially planar indicia body 110 may tightly abut the immediate outside surface of the external wall 12 of the luggage container 10 when the pin portion 124 of any seated fastener member 120 is securely engaged by the corresponding pin retaining component 126 as the abutment surface 128 of the pin retaining component 126 rests tightly against the immediate inside surface 18 of the external wall 12 of the luggage container 10.

Figure 7A:
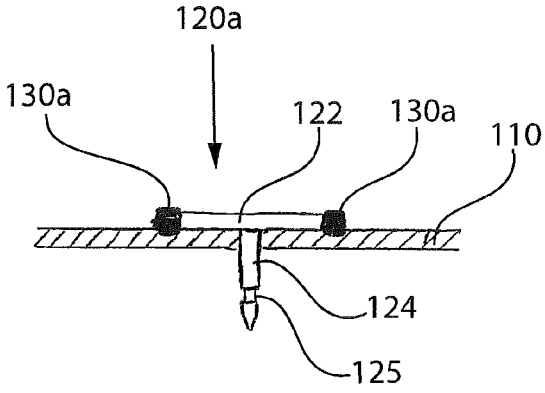
FIG. 7A depicts a side cross-section view of an embodiment of a fastener seat of an embodiment of a luggage identification apparatus, in accordance with the present invention.
Figure 7B:
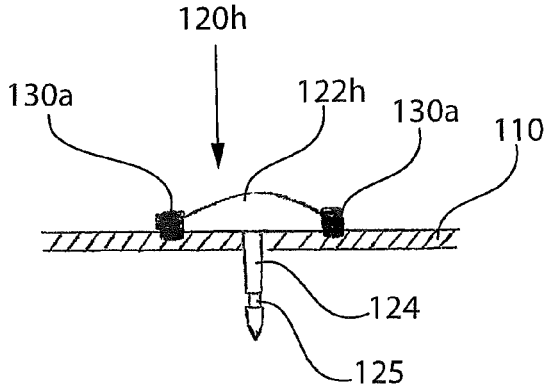
FIG. 7B depicts a side cross-section view of another embodiment of a fastener seat of an embodiment of a luggage identification apparatus, in accordance with the present invention
Figure 7C:
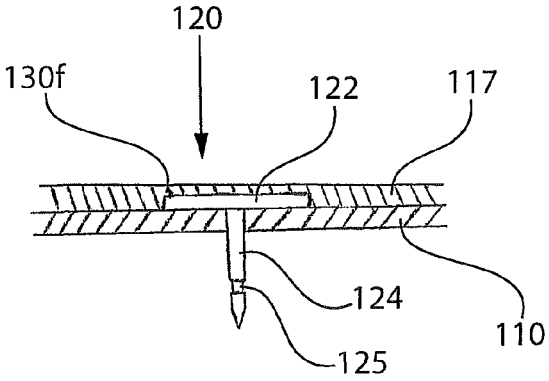
FIG. 7C depicts a side cross-section view of still another embodiment of a fastener seat of an embodiment of a luggage identification apparatus, in accordance with the present invention.

As depicted in FIG. 7C, embodiments of a luggage container identification apparatus 100 may include a substantially planar indicia body 110 that has a fastener member cover element 117. The cover element 117 may be removably attached to the indicia body 110, permanently attached to the indicia body 110, and/or it may be integrally formed therewith. The cover element 117 should be sized, formed and located so that it comprises a fastener seat 130*f* for seating and covering a corresponding mechanical fastener member 120. As shown, the retaining head 122 of the fastener member 120 may be covered, encased, or otherwise enshrouded by the cover element 117, while the fastener member 120 is located in the corresponding fastener seat 130*f* so that the pin portion 124 extends through at least a portion of the indicia body 110. In this manner, the retaining head 122 of the fastener member 120 is completely obscured and protected from contact by external objects, thereby helping to keep the fastener member 120 in a secure location with respect to the indicia body 110. The cover element 117 may be placed over the retaining head 122 of a seated fastener member 120 and may be attached to the indicia body 110 via stitching, gluing, welding, sealing, or other operable attachment means. Moreover, the cover element 117 may be integrally formed with the indicia body 110 as the fastener member 120 is associatively seated in the fastener seat 130*f*. Additionally, the fastener member 120 may include orifices that permit stitching to be sewed through all of the cover element 117, the fastener member 120, and the indicia body, thereby the securing the fastener member 120 in place. When the retaining head 122 of a fastener member 120 is positioned under a cover element 117 the engagement surface feature 125 of the pin portion 124 sticking through the indicia body 110 should be available for engagement with a tab 127 of a pin retaining component 126 (shown in FIGS. 5-6). A cover element 117 may comprise a physical structure that significantly laterally shields the fastener member 120, thereby preventing the fastener member 120 from being snagged by lateral contact with external objects.

A method of identifying a luggage container, such as luggage container 10, is described in reference to FIGS. 1-7C. The luggage identification method may comprise providing a luggage container identification apparatus 100. The luggage container identification apparatus 100 may include a flexible indicia body 110 having an identification indicia 150 located thereon. Furthermore, the luggage identification apparatus 100 may include a plurality of fastener seats 130, each fastener seat 130 being located near the perimeter of the flexible indicia body 110. In addition, a luggage ID apparatus 100 may include a plurality of mechanical fastener members 120. Each of fastener members 120 may include a retaining head 122, sized and shaped to correspond in dimension with a fastener seat 130. Moreover, each fastener member 120 may also include a rigid pin portion 124, the pin portion 124 configured to pierce and extend through both an external wall 14 of a luggage container 10 and at least a portion of the flexible indicia body 110. Additionally, each fastener member 120 may further include a pin retaining component 126, configured to securely releasably engage an external surface feature 125 of the pin portion 124. Further luggage identification methodology may include positioning each mechanical fastener member 120 in a corresponding fastener seat 130 so that edges 123 of the retaining head 122 of each seated mechanical fastener member 120 are significantly obscured by the fastener seat 130. Still further, another luggage identification method step may include attaching the indicia body 110 to the luggage container 10 by binding the external wall 12 of the luggage container 10 and the at least a portion of the indicia body 110 between the retaining head 120 and the pin retaining component 126 when the pin portion 124 is positioned to extend through the external wall 12 of the luggage container 10 and through the at least a portion of the indicia body 110. When the indicia body 110 is attached to the luggage container 10, additional luggage identification methodology may include each fastener member 120 being located and configured so that edge portions 123 of each retaining head 122 of each fastener member 120 are significantly laterally shielded by physical structures of the indicia body 120, thereby preventing the fastener members 120 from being snagged by lateral contact with external objects during typical luggage handling processes.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

What is claimed is:

1. A removable luggage container identification apparatus comprising:

a flexible substantially planar body, having a first face and an opposing second face, the first face including an identification indicia located thereon;

a plurality of fastener seats, each fastener seat being located near the perimeter of the first face of the planar body, wherein the fastener seat is formed of embroidered material; and a plurality of mechanical fastener members, each fastener member including:

a retaining head, sized and shaped to correspond in dimension with a fastener seat;

a rigid pin portion, configured to pierce and transverse both the substantially planar body and an external wall of a luggage container; and a pin retaining component, configured to securely releasably engage the pin portion;

wherein, each mechanical fastener member is seated in a corresponding fastener seat so that edges of the retaining head of each seated mechanical fastener member are significantly obscured by the fastener seat; and further wherein an immediate portion of the second face of the substantially planar body tightly abuts the immediate outside surface of the external wall of the luggage container when the pin portion of any seated fastener member is securely engaged by the corresponding retaining component as the pin retaining component rests tightly against the immediate inside surface of the external wall of the luggage container.

2. The removable luggage container identification apparatus of claim 1, wherein the fastener member is a clutch pin having a grooved surface feature located on the pin member and the pin retaining member includes a compliant squeeze tab to securely releasably engage the pin portion.

3. The removable luggage container identification apparatus of claim 1, wherein the pin portion has a length corresponding to the combined thickness of the substantially planar body and the thickness the external wall of a luggage container.

4. The removable luggage container identification apparatus of claim 1, further comprising a cover element attached to the substantially planar body, the cover element being sized, formed and located so that it covers a corresponding mechanical fastener member.

5. The removable luggage container identification apparatus of claim 1, wherein the retaining head of each fastener member is circular.

6. The removable luggage container identification apparatus of claim 1, wherein the fastener seats are integrally formed with the substantially planar body.

7. A removable luggage container identification apparatus comprising:

an indicia body, the indicia body having identification indicia located thereon; and a plurality of mechanical fastener members, each fastener member including a rigid pin portion extending from a retaining head and a separable pin retaining component operable to securely releasably engage an external surface feature of the pin portion to facilitate attachment of the indicia body to a luggage container by binding an external surface of the luggage container and at least a portion of the indicia body between the retaining head and the pin retaining component when the pin portion is positioned to extend through the external surface of the luggage and through the at least a portion of the indicia body;

wherein when the indicia body is attached to the luggage container, each fastener member is located and configured so that the retaining head of each fastener member is substantially laterally shielded by physical structures of the indicia body, thereby preventing each of the fastener members from being snagged by lateral contact with external objects, wherein the physical structures that laterally shield the fastener member are formed of embroidered material.

8. The removable luggage container identification apparatus of claim 7, wherein the fastener member is a clutch pin having a grooved surface feature located on the pin member and the pin retaining member includes a compliant squeeze tab to securely releasably engage the pin portion.

9. The removable luggage container identification apparatus of claim 7, wherein the identification indicia is a removable patch attachable to the indicia body via hook and loop fasteners.

10. The removable luggage container identification apparatus of claim 7, further comprising a cover element attached to the indicia body, the cover element being sized, formed and located so that it covers a corresponding mechanical fastener member.

11. The removable luggage container identification apparatus of claim 7, wherein the retaining head of each fastener member is circular.

12. The removable luggage container identification apparatus of claim 7, wherein the physical structures that laterally shield the fastener member are integrally formed with the indicia body.

13. A method of identifying a luggage container, the method comprising:

providing a luggage container identification apparatus including:

a flexible indicia body having an identification indicia located thereon;

a plurality of fastener seats, each fastener seat being located near the perimeter of the flexible indicia body; and a plurality of mechanical fastener members, each fastener member including:

a retaining head, sized and shaped to correspond in dimension with a fastener seat;

a rigid pin portion, configured to pierce and extend through both an external wall of a luggage container and at least a portion of the flexible indicia body; and a pin retaining component, configured to securely releasably engage an external surface feature of the pin portion;

positioning each mechanical fastener member in a corresponding fastener seat so that edges of the retaining head of each seated mechanical fastener member are significantly obscured by the fastener seat; and attaching the indicia body to the luggage container by binding the external wall of the luggage container and the at least a portion of the indicia body between the retaining head and the pin retaining component when the pin portion is positioned to extend through the external wall of the luggage container and through the at least a portion of the indicia body;

wherein when the indicia body is attached to the luggage container, each fastener member is located and configured so that edge portions of each retaining head of each fastener member are significantly laterally shielded by physical structures of the indicia body, thereby preventing the fastener members from being snagged by lateral contact with external objects, wherein the physical structures that laterally shield the fastener member are formed of embroidered material.

14. The method of identifying a luggage container of claim 13, wherein the fastener member is a clutch pin having a grooved surface feature located on the pin member and the pin retaining member includes a compliant squeeze tab to securely releasably engage the pin portion.

15. The method of identifying a luggage container of claim 13, wherein the identification indicia is a removable patch attachable to the indicia body via hook and loop fasteners.

16. The method of identifying a luggage container of claim 13, further comprising a cover element attached to the indicia body, the cover element being sized, formed and located so that it covers a corresponding mechanical fastener member.

17. The method of identifying a luggage container of claim 13, wherein the retaining head of each fastener member is circular.

18. The method of identifying a luggage container of claim 13, wherein the physical structures that laterally shield the fastener member are integrally formed with the indicia body.

* * * * *